US008853922B2

(12) United States Patent
Horn et al.

(10) Patent No.: US 8,853,922 B2
(45) Date of Patent: Oct. 7, 2014

(54) SCAVENGERS FOR REDUCING CONTAMINANTS IN LIQUID-FILLED LED BULBS

(71) Applicant: Switch Bulb Company, Inc., San Jose, CA (US)

(72) Inventors: David Horn, Saratoga, CA (US); Chris Vogdes, Sunnyvale, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

(21) Appl. No.: 14/051,418

(22) Filed: Oct. 10, 2013

(65) Prior Publication Data

US 2014/0033512 A1 Feb. 6, 2014

Related U.S. Application Data

(62) Division of application No. 13/231,855, filed on Sep. 13, 2011, now Pat. No. 8,558,436.

(51) Int. Cl.

| | |
|---|---|
| ***H01J 7/26*** | (2006.01) |
| ***H01J 9/395*** | (2006.01) |
| ***F21K 99/00*** | (2010.01) |
| ***F21V 29/02*** | (2006.01) |
| ***F21V 29/00*** | (2006.01) |
| *F21V 3/00* | (2006.01) |
| *F21Y 111/00* | (2006.01) |
| *F21Y 101/02* | (2006.01) |

(52) U.S. Cl.

CPC . *H01J 7/26* (2013.01); *F21V 3/005* (2013.01); *F21Y 2111/007* (2013.01); *F21K 9/135* (2013.01); *F21V 29/022* (2013.01); *F21Y 2101/02* (2013.01); *F21V 29/248* (2013.01); *F21V 29/004* (2013.01); *H01J 9/395* (2013.01)

USPC ..... 313/46; 313/22; 313/36; 362/294

(58) Field of Classification Search

CPC ..... F21V 29/022

USPC ..... 313/22, 11, 12, 24, 46

See application file for complete search history.

(56) References Cited

U.S. PATENT DOCUMENTS

| | | | |
|---|---|---|---|
| 5,147,130 | A | 9/1992 | Watanuki |
| 5,593,482 | A | 1/1997 | Dauber et al. |
| 5,971,565 | A | 10/1999 | Zapata et al. |
| 7,419,601 | B2 | 9/2008 | Cooper et al. |
| 7,553,355 | B2 | 6/2009 | Torres, Jr. et al. |
| 8,373,343 | B2 | 2/2013 | Michels et al. |
| 2004/0223342 | A1 | 11/2004 | Klipstein et al. |

(Continued)

OTHER PUBLICATIONS

International Search Report and Written Opinion received for PCT Patent Application No. PCT/US2012/54893, mailed on Nov. 23, 2012, 9 pages.

(Continued)

*Primary Examiner* — Elmito Breval

(74) *Attorney, Agent, or Firm* — Morrison & Foerster LLP

(57) ABSTRACT

A liquid-cooled light emitting diode (LED) bulb which includes a base, a shell connected to the base forming an enclosed volume, and a plurality of LEDs attached to the base and disposed within the shell. The LED bulb also includes a volume of thermally-conductive liquid held within the enclosed volume. A scavenger element comprising a scavenger material is attached to the base and is exposed to the thermally-conductive liquid. The scavenger material is configured to capture contaminants in the thermally-conductive liquid.

6 Claims, 9 Drawing Sheets

(56) References Cited

U.S. PATENT DOCUMENTS

| | | | |
|---|---|---|---|
| 2007/0034515 | A1 | 2/2007 | Kong et al. |
| 2009/0001372 | A1 | 1/2009 | Arik et al. |
| 2009/0309473 | A1 | 12/2009 | Lenk et al. |
| 2011/0193479 | A1 | 8/2011 | Nilssen et al. |

OTHER PUBLICATIONS

Notice of Allowance received for U.S. Appl. No. 13/231,855, mailed on Jun. 13, 2013, 9 pages.

SCAVENGERS FOR REDUCING CONTAMINANTS IN LIQUID-FILLED LED BULBS

CROSS REFERENCE TO RELATED APPLICATIONS

This application is a divisional and claims the benefit under 35 U.S.C. 120 of prior copending U.S. patent application Ser. No. 13/231,855, filed Sep. 13, 2011.

BACKGROUND

1. Field

The present disclosure relates generally to reducing contaminants in an optically translucent liquid, and more specifically to using a scavenger material to reduce contaminants in a liquid-filled light-emitting diode (LED) bulb.

2. Description of the Related Art

Traditionally, lighting has been generated using fluorescent and incandescent light bulbs. While both types of light bulbs have been reliably used, each suffers from certain drawbacks. For instance, incandescent bulbs tend to be inefficient, using only 2-3% of their power to produce light, while the remaining 97-98% of their power is lost as heat. Fluorescent bulbs, while more efficient than incandescent bulbs, do not produce the same warm light as that generated by incandescent bulbs. Additionally, there are health and environmental concerns regarding the mercury contained in fluorescent bulbs.

Thus, an alternative light source is desired. One such alternative is a bulb utilizing an LED. An LED comprises a semiconductor junction that emits light due to an electrical current flowing through the junction. Compared to a traditional incandescent bulb, an LED bulb is capable of producing more light using the same amount of power. Additionally, the operational life of an LED bulb is orders of magnitude longer than that of an incandescent bulb, for example, 10,000-100,000 hours as opposed to 1,000-2,000 hours.

While there are many advantages to using an LED bulb rather than an incandescent or fluorescent bulb, LEDs have a number of drawbacks that have prevented them from being as widely adopted as incandescent and fluorescent replacements. One drawback is that an LED, being a semiconductor, generally cannot be allowed to get hotter than approximately 120° C. As an example, A-type LED bulbs have been limited to very low power (i.e., less than approximately 8 W), producing insufficient illumination for incandescent or fluorescent replacements.

One approach to alleviating the heat problem of LED bulbs is to fill an LED bulb with a thermally-conductive liquid, to transfer heat from the LEDs to the bulb's shell. The heat may then be transferred from the shell out into the air surrounding the bulb.

However, in some circumstances, the thermally-conductive liquid may become contaminated with organics and/or other material. Contaminating organics may be the result of volatile organic compounds (VOCs) that have been emitted from bulb components and became trapped in the thermally-conductive liquid. Other contaminating materials may be soluble or insoluble depending on the temperature and concentration. For example, soluble contaminants may form due to prolonged exposure to certain elastomers, such as Viton. Insoluble or particulate contaminants may form when soluble contaminants cool and solidify in the thermally-conductive liquid. Particulate contaminants due to the presence of elastomers are also referred to herein as elastomer precipitate.

Over time, organic and other contaminants may discolor optical materials in the LED bulb and degrade the quality of light produced by the LED bulb. The contaminants may also interfere with the operation of the LEDs and cause premature failure of the LED bulb. Thus, a method and system for reducing contaminants in a liquid-filled LED bulb is desired.

SUMMARY

In one exemplary embodiment, a liquid-cooled LED bulb includes a base, a shell connected to the base forming an enclosed volume, and a plurality of LEDs attached to the base and disposed within the shell. The LED bulb also includes a thermally-conductive liquid held within the enclosed volume. A scavenger element is attached to the base and comprises a scavenger material that is configured to capture contaminants in the thermally-conductive liquid. The scavenger element is attached to the base in a location that exposes the scavenger material to the thermally-conductive. In some embodiments, the scavenger element is attached in a location that allows the thermally-conductive fluid to circulate through the scavenger material via passive convective flow.

DETAILED DESCRIPTION

Figure 1:
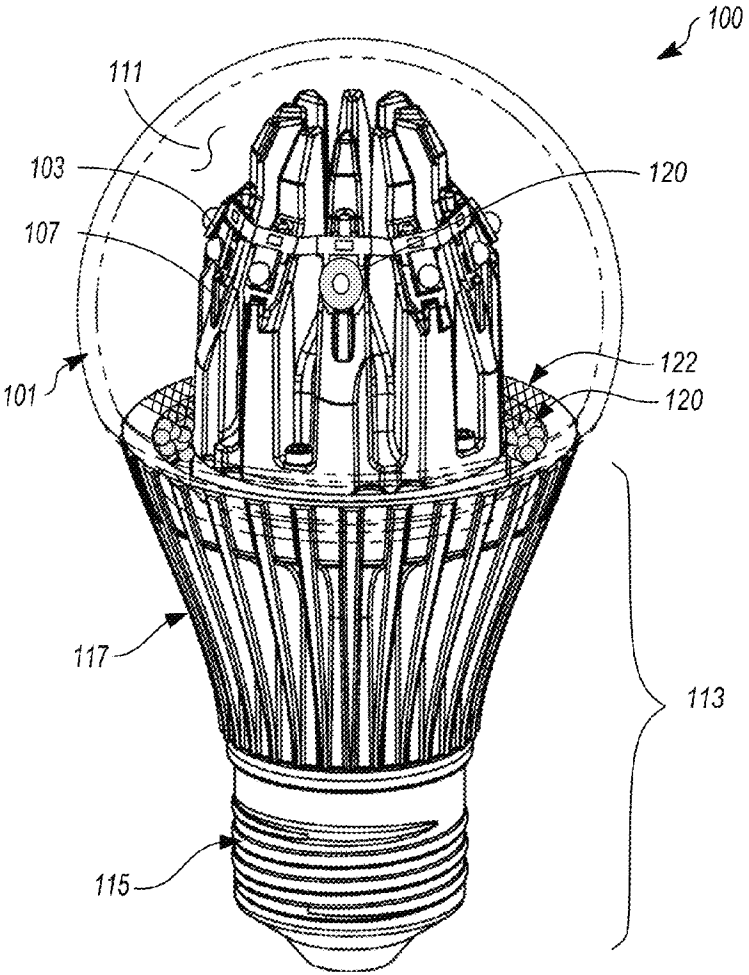
FIG. 1 depicts a liquid-filled LED bulb.

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

As mentioned above, one technique for dissipating the heat generated by the LED semiconductors in an LED bulb is to fill the bulb with a thermally-conductive liquid. Heat is transferred from the LEDs to the thermally-conductive liquid which is able to conduct the heat to other parts of the LED bulb. The thermally-conductive liquid typically surrounds the light emitting portion of the LEDs, and therefore the thermally-conductive liquid also serves as a medium for transmitting light emitted from the LEDs.

Over time, organic contaminants and/or other contaminant materials may become trapped in the thermally-conductive liquid and degrade the optical qualities of the LED bulb. For example, organic contaminants may build up near the LED or become trapped in an optical lens attached to the face of an LED. In some cases, the organic contaminants may react with the lens material and cause discoloration. Additionally, the organic contaminants may oxidize in the presence of heat and light and become dark or opaque. Over time, the discoloration and/or organic contaminant buildup near the LED may block a significant amount of light from the LED and reduce the overall illumination intensity of the LED bulb.

The illumination intensity of the LED bulb may also be affected by other contaminant materials that have become trapped in the thermally-conductive liquid. For example, soluble contaminants may form due to prolonged exposure to certain elastomers, such as Viton. Insoluble or particulate contaminants (e.g., elastomer precipitate) may form when soluble contaminants cool and solidify in the thermally-conductive liquid. In sufficient quantities, the particulate contaminants may cloud the thermally-conductive liquid and reduce the overall illumination intensity of the LED bulb. The discussion above represents specific examples of contaminant materials in an LED bulb. However, contaminants may also include materials other than the examples given above.

The LED bulbs described herein provide the ability to capture organic and other contaminants with the addition of a scavenger material so that the optical quality of the thermally-conductive liquid is maintained and the LED bulb does not fail prematurely. Specifically, a scavenger material can be placed in contact with the thermally-conductive liquid to reduce the presence of organic or other contaminants in solution with or suspended in the thermally-conductive liquid. Exemplary scavenger materials may have a microporous structure with a high surface area to weight ratio. Exemplary scavenger materials include activated carbon, activated alumina, silica gel, clays, and organic metal oxides. Other exemplary scavenger materials include molecular sieve materials capable of trapping molecules of a certain size. In some cases, scavenger materials may incorporate an ion exchange medium to capture organic contaminants.

As most scavenger materials are opaque solids, it may be advantageous to prevent the scavenger materials from entering the light transmitting areas of the thermally-conductive liquid, potentially blocking the LED light. It may also be advantageous to prevent scavenger materials from interfering with electronics that may also be present in the thermally-conductive liquid. In the embodiments described below, the scavenger material may be part of a scavenger element that is attached to a component of the LED bulb in a location that prevents the scavenger material from floating free within the LED bulb. In some embodiments, the scavenger element may include a liquid-permeable chamber or container at least partially filled with the scavenger material. In some embodiments, the scavenger element may be comprised of a scavenger material that a solid plug or a material that is woven into a cloth that can be attached to a component of the LED bulb.

The scavenger element should be placed in a location within the LED bulb that allows for contact with the thermally-conductive liquid without interfering with the light emitting qualities of the LED bulb. In some embodiments, the thermally-conductive liquid is circulated through or around the scavenger material by passive-convective currents caused by the temperature difference between the LED and the outer components of the LED bulb.

As illustrated in the examples below, the presence of scavenger materials in a thermally-conductive liquid can reduce the contamination level in an LED bulb as indicated by reduced light absorption over measured wavelengths. Also illustrated in the examples below, the efficacy of certain scavenger materials is improved at temperatures higher than room temperature. The improved performance at elevated temperatures may be advantageous in liquid-filled LED bulb applications. For example, in the liquid-filled LED bulb described below with respect to FIG. 1, the thermally-conductive liquid is typically at an elevated temperature (with respect to room temperature) due to the heat generated by the LED operation. Thus, the LED bulb of FIG. 1 may be well suited for use with certain scavenger materials.

1. Liquid-Filled LED Bulb

Various embodiments are described below relating to LED bulbs. As used herein, an "LED bulb" refers to any light-generating device (e.g., a lamp) in which at least one LED is used to generate light. Thus, as used herein, an "LED bulb" does not include a light-generating device in which a filament is used to generate the light, such as a conventional incandescent light bulb. It should be recognized that the LED bulb may have various shapes in addition to the bulb-like A-type shape of a conventional incandescent light bulb. For example, the bulb may have a tubular shape, a globe shape, or the like. The LED bulb of the present disclosure may further include any type of connector; for example, a screw-in base, a dual-prong connector, a standard two- or three-prong wall outlet plug, bayonet base, Edison Screw base, single-pin base, multiple-pin base, recessed base, flanged base, grooved base, side base, or the like.

FIG. 1 depicts an exemplary LED bulb 100 in a perspective view. For convenience, all examples provided in the present disclosure describe and show LED bulb 100 being a standard A-type form factor bulb. However, as mentioned above, it should be appreciated that the present disclosure may be applied to LED bulbs having any shape, such as a tubular bulb, a globe-shaped bulb, or the like.

In some embodiments, LED bulb 100 may use 6 W or more of electrical power to produce light equivalent to a 40 W incandescent bulb. In some embodiments, LED bulb 100 may use 20 W or more to produce light equivalent to or greater than a 75 W incandescent bulb. Depending on the efficiency of the LED bulb 100, between 4 W and 16 W of heat energy may be produced when the LED bulb 100 is illuminated.

LED bulb 100 includes a shell 101 and base 113, which interact to form an enclosed volume 111 over one or more LEDs 103. Shell 101 may be made from any transparent or translucent material such as plastic, glass, polycarbonate, or the like. Shell 101 may include dispersion material spread throughout the shell to disperse light generated by LEDs 103. The dispersion material prevents LED bulb 100 from appearing to have one or more point sources of light.

LED bulb 100 includes a plurality of LEDs 103 mounted in a radial pattern within the shell 101. In some cases, each LED 103 has a small lens mounted on the light emitting face of the LED. The lens may be made from silicone, polycarbonate, or other optically translucent material. The lens is mechanically attached to the LED using an adhesive or mechanical fastening technique.

The plurality of LEDs 103 are attached to LED mounts 107. LED mounts 107 may be made of any thermally-conductive material, such as aluminum, copper, brass, magnesium, zinc, or the like. Since LED mounts 107 are formed from a thermally-conductive material, heat generated by LEDs 103 may be conductively transferred to LED mounts 107. The LED mounts 107 are at least partially immersed in the thermally-conductive liquid and, therefore, are able to dissipate heat to the thermally-conductive liquid. Thus, LED mounts 107 may act as a heat sink or heat spreader for LEDs 103. LED mounts 107 may be finger-shaped projections with LEDs 103 mounted on the sides, as shown in FIG. 1. In another embodiment, LEDs 103 may be mounted on the top portions of LED mounts 107.

Base 113 of LED bulb 100 includes LED mounts 107, a connector 115 for connecting the bulb to a lighting fixture, and a heat spreader 117. The heat spreader 117 may be made of any thermally-conductive material, such as aluminum, copper, brass, magnesium, zinc, or the like. Heat spreader 117 may be thermally coupled to one or more of shell 101, LED mounts 107, and/or a thermally-conductive liquid disposed in enclosed volume 111. Thermal coupling allows some of the heat generated by LEDs 103 to be conducted to and dissipated by heat spreader 117. Preferably, LED bulb 100 is configured so that the operating temperature of heat spreader 117 does not reach levels at which it can burn a user, given the external placement of heat spreader 117.

As discussed above, shell 101 and base 113 of LED bulb 100 interact to define an enclosed volume 111. A thermally-conductive liquid fills the volume 111. As used herein, the term "liquid" refers to a substance capable of flowing. Also, the substance used as the thermally-conductive liquid is a liquid or at the liquid state within, at least, the operating, ambient-temperature range of the bulb. An exemplary temperature range includes temperatures between −40° C. to +40° C. The thermally-conductive liquid may be mineral oil, silicone oil, glycols (PAGs), fluorocarbons, or other material capable of flowing. In the examples discussed below, 20 cSt viscosity polydimethylsiloxane (PDMS) liquid sold by Clearco is used as a thermally-conductive liquid. It may be desirable to have the liquid chosen be a non-corrosive dielectric. Selecting such a liquid can reduce the likelihood that the liquid will cause electrical shorts and reduce damage done to the components of LED bulb 100.

As described above, the thermally-conductive liquid is able to transfer heat away from the LEDs 103 and the LED mounts 107. Typically, the thermally-conductive liquid transfers the heat via conduction and convection to other components of the LED bulb 100 including the shell 101 and base 113. As a result of the heat transfer, the temperature of the thermally-conductive liquid is typically above the ambient or room temperature. The increase in temperature depends on the number of LEDs, the total wattage of the LED bulb and the physical configuration of components of the LED bulb. Typically, the temperature of the thermally-conductive liquid is between 85° C. and 120° C.

Also as described above, the thermally-conductive liquid 110 acts as an optical medium by transmitting the light emitted from the LEDs 103 to the translucent shell 101. Thus, the optical properties of the thermally-conductive liquid are important to the quality of light that is produced by the LED bulb.

However, components of the LED bulb 100, including solder, flux, adhesives and polymers, may produce contaminants that may seep into the thermally-conductive liquid over time. For example, organic contaminants due to the presence of volatile organic compounds (VOCs) may be appear in the thermally-conductive liquid when the thermally-conductive liquid comes in contact with certain adhesives, polymers, or solder flux in the LED bulb materials. In some cases, other contaminants may be created due to a precipitate that forms when the thermally-conductive liquid is exposed to elastomers, such as Viton.

Figure 2A:
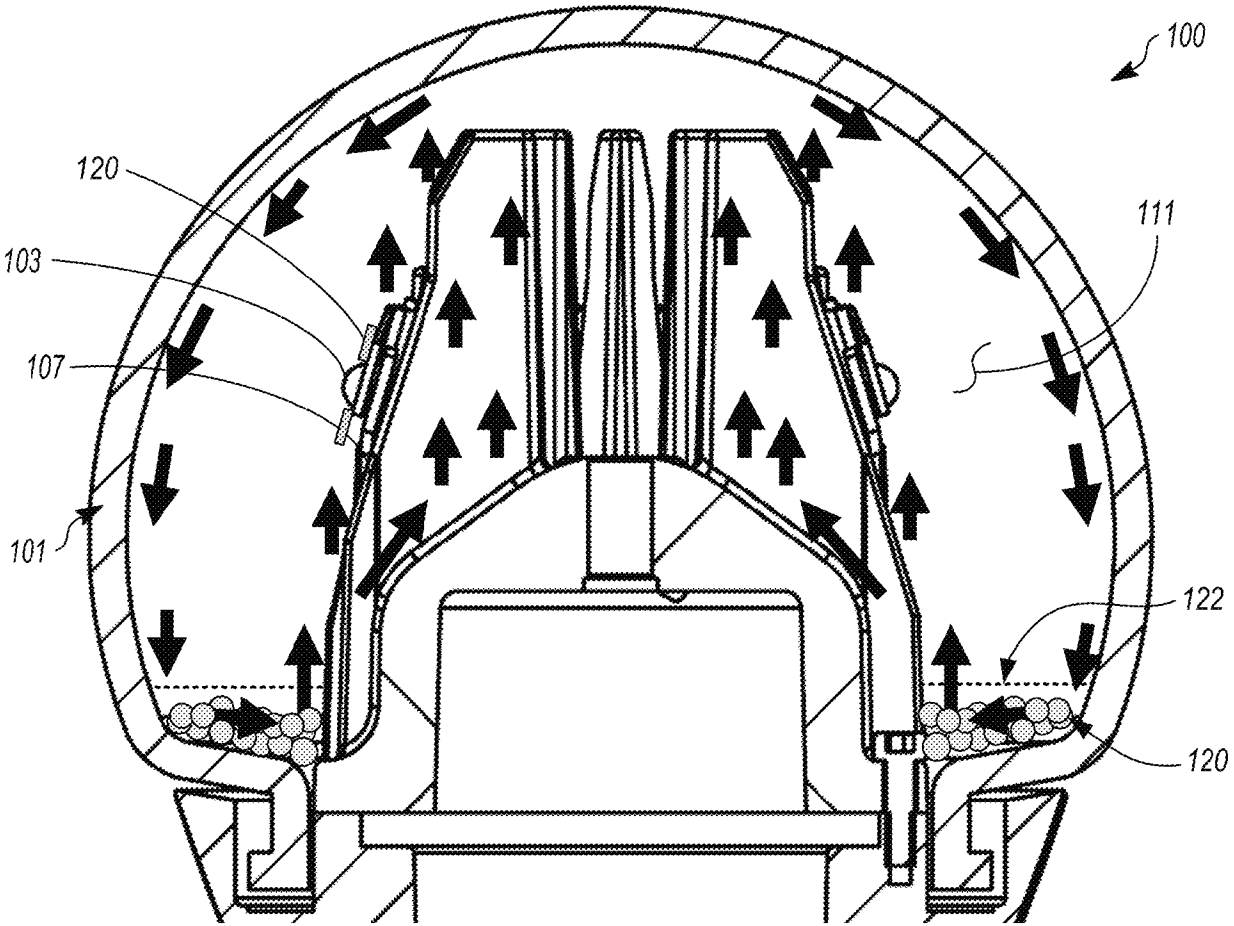
FIGS. 2A and 2B depict passive convective currents in a liquid-filled LED bulb.
Figure 2B:
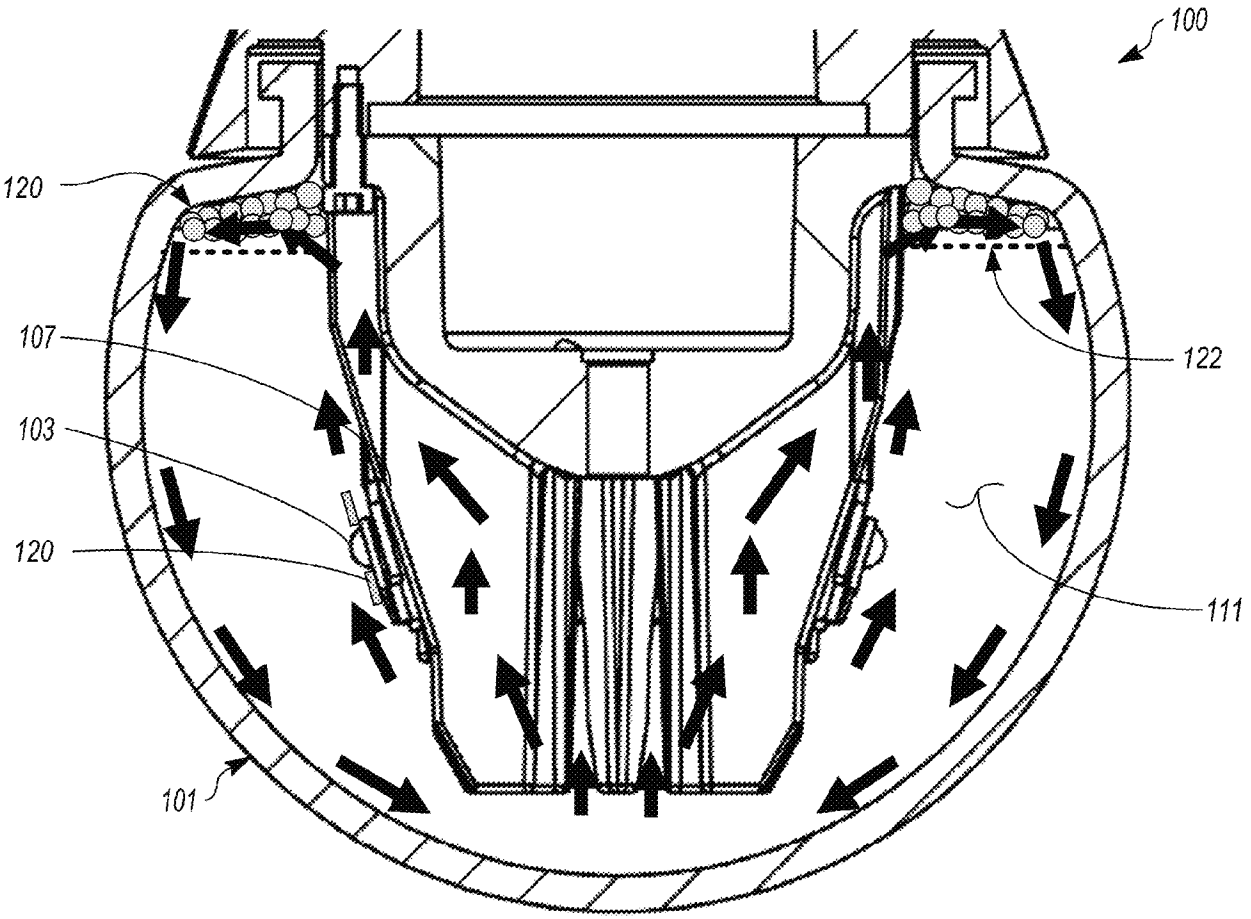

As discussed above, a scavenger material can be used to reduce or eliminate contaminants in the thermally-conductive liquid. For example, as shown in FIGS. 1, 2A, and 2B, a scavenger element 120 includes a scavenger material and can be placed in the enclosed volume 111 in a allows the scavenger element 120 to be, at least, partially submerged in the thermally-conductive liquid. The scavenger material of the scavenger element 120 is able to capture free-floating contaminants and improve or maintain the optical quality of the thermally-conductive liquid. The scavenger element 120 can be removed from the bulb or can remain in contact with the thermally-conductive liquid to capture additional contaminants as they are generated.

The scavenger element 120 is typically attached to the base 113 in a location that prevent the scavenger material from blocking the light emitted from the LEDs 103. If the scavenger element 120 is in a granular form, the scavenger element 120 may be at least partially contained by a liquid-permeable membrane 122, which is attached to the base 113. As shown in FIGS. 1, 2A, and 2B, the liquid-permeable membrane 122 traps the scavenger element 120 in a chamber located within the base 113. The liquid-permeable membrane 122 allows thermally-conductive liquid to pass through while holding the scavenger element 120 within the chamber.

In another embodiment, the scavenger element 120 may be adhered to portions of the base 113 that are exposed to the thermally-conductive liquid. For example, as shown in FIG. 1, the scavenger element 120 may be a ring or patch of cloth material. The cloth may be attached to the base 113 using an adhesive or mechanical fastener. As shown in FIG. 1, the scavenger element 120 can be a ring of cloth material that is attached to the LED mounts 107 so that the ring of cloth material surrounds at least one LED 103.

In general, the scavenger element 120 should be placed in a location that allows the thermally-conductive liquid to come into contact with the scavenger material. To improve contaminant capturing, it may be beneficial to place the scavenger element 120 in a location that provides exposure to the thermally-conductive liquid as it is circulated within the LED bulb. As shown in FIGS. 2A and 2B, the thermally-conductive liquid may circulate within the enclosed volume 111 via passive convection due to temperature differentials within the thermally-conductive liquid. For example, the thermally-conductive liquid near the LEDs 103 is typically warmer than thermally-conductive liquid near the shell 101, which causes a temperature differential within the thermally-conductive liquid.

As shown in FIG. 2A, thermally-conductive liquid near LEDs 103 is heated by the operation of the LEDs. The heated thermally-conductive fluid rises to the top of the enclosed volume 111 and then cools by conducting heat to the shell 101 and other components of the LED bulb 100. The arrows depicted in FIG. 2A represent exemplary passive convective currents in the thermally-conductive liquid. Similarly, FIG. 2B depicts arrows representing the exemplary passive convective flow when the LED bulb 100 is in an inverted orientation. As shown in FIGS. 2A and 2B, the scavenger elements 120 are placed within the enclosed volume 111 at a location that allows the thermally-conductive liquid to circulate through the scavenger element 120 via passive convective flow.

As an alternative or additional embodiment, the scavenger elements 120 can be placed on the LED mounts 107 near the LEDs 103. As shown in FIGS. 2A and 2B, the area near the LEDs 103 is proximate to a current of the passive convective flow. In some cases, this is advantageous in that contaminants may be captured before the contaminants affect the optical quality of the LEDs 103. As one example shown in FIG. 1, the scavenger element 120 may include a ring of cloth attached to the LED mount 1, which surrounds the LED 103.

The scavenger element 120 includes a scavenger material that is able to capture contaminants in the thermally-conductive liquid. In one example, the scavenger element 120 may include activated-carbon granules. The activated-carbon granules may be added to the thermally-conductive liquid in a concentration of approximately 0.02 g/ml of thermally-conductive liquid. However, the amount of activated-carbon granules may vary in concentrations from greater than 0.001 to less than 0.1 g/ml of thermally-conductive liquid. The concentration of the activated-carbon granules may be increased to compensate for increased expected contaminant levels and/or increased service life of the thermally-conductive liquid.

The scavenger element 120 may include a scavenger material with a microporous structure that has a high surface area to weight ratio. In some cases, the scavenger material is an activated carbon, activated alumina, silica gel, clay, organic metal oxide, or molecular sieve material. As mentioned above, the scavenger material may be in a granular form, a cloth weave, sheet form, sintered powder, sintered granules, or other form. Exemplary scavenger materials include: granular activated carbon 1240 made from lignite coal; and 8×14 US mesh activated alumina, Grade DD-6 supplied by BASF.

2. Examples Using Scavenger Materials to Reduce Contaminants

The following examples demonstrate how scavenger materials can be used to reduce or eliminate contaminants in a thermally-conductive liquid. In each of the examples, UV-visible light spectroscopy was used to detect organic contaminants in the thermally-conductive liquid. To detect organic compounds, peak absorbance for a band of wavelengths between 200 nm and 700 nm was measured for each of the samples and the results plotted over time. Absorbance $A_\lambda$ is a unitless measure of the amount of light that is absorbed by a medium and can be expressed as:

$$A_\lambda = \log_{10}(I_0/I), \qquad \text{Equation 1}$$

where $I_0$ is the intensity of the light (at a specified wavelength $\lambda$) before it enters the medium, and I is the intensity of light that has passed through the medium. The absorbance numbers reported in the examples below have also factored out the base-line absorbance of an uncontaminated liquid using the measured absorbance of a control sample.

In general, the absorbance peak is roughly proportional to the concentration of light-absorbing organic compounds. A zero absorbance over frequencies ranging between 200 nm and 700 nm indicates low or zero concentration of light-absorbing organic compound contaminants. In the examples given below, samples having a higher peak absorbance are considered to have a higher level of contamination than samples having a lower peak absorbance. The absorbance peak may not be indicative of the level of contaminants that do not absorb UV-visible light over the measured range. However, a reduction in light-absorbing organic contaminants may still be advantageous in LED light bulb applications because a reduction indicates that there will be fewer contaminants to react with and potentially interfere with the light emitted from the LEDs.

A. Removal of Solder Flux Contaminant Using Carbon Granules

In this example, a scavenger material comprised of granulated carbon was analyzed for effectiveness. The scavenger material was used to treat a thermally-conductive liquid having contaminants created by solder flux.

To create a flux-contaminated liquid, five 1 mm dots of Indalloy solder with NC-SMQ92J flux were placed on clean copper strip. The strip, solder, and flux were heated to 200° C. on a hotplate until the flux and solder had melted and spread over the surface of the copper strip. The copper strip was not cleaned to remove excess flux and was placed in approximately 100 ml of Clearco 20 cSt PDMS liquid. The immersed strip was placed in an oven and aged at 135° C. for 120 hours. Aging the sample at an elevated temperature accelerates the simulated exposure to the flux material. The resulting composition is referred to herein as flux-contaminated PDMS.

The presence of the solder and/or flux in the flux-contaminated PDMS resulted in an increase in the concentration of organic compounds in the thermally-conductive liquid. The increase in concentration was evidenced by a significant increase in peak absorbance compared to untreated PDMS liquid. Specifically, the peak absorbance of the flux-contaminated PDMS was measured at 1.2 over the UV-visible spectrum of 200-700 nm.

To treat the flux-contaminated liquid, 0.3 g of washed, granular, activated carbon was added to a scintillation vial having approximately 18 ml of the flux-contaminated PDMS. For purposes of this discussion, "washed" refers to granular, activated carbon that has been triple rinsed in acetone and then dried. The vial was placed in an oven for 72 hours at 125° C. Aging the samples at elevated temperatures simulates the long-term effects in an operating LED bulb. After cooling to room temperature (approximately 20° C.), the flux-contaminated PDMS with carbon showed no absorbance in the UV region. This indicates a zero or nearly zero concentration of organic compound contaminants in solution or suspended in the thermally-conductive liquid.

This experiment was repeated with 0.3 g of washed, granular, activated carbon added to 10 ml of flux-contaminated PDMS and aged at 125° C., 85° C., and 20° C. (room temperature or RT). The peak absorbance of each sample was monitored over time.

Figure 3:
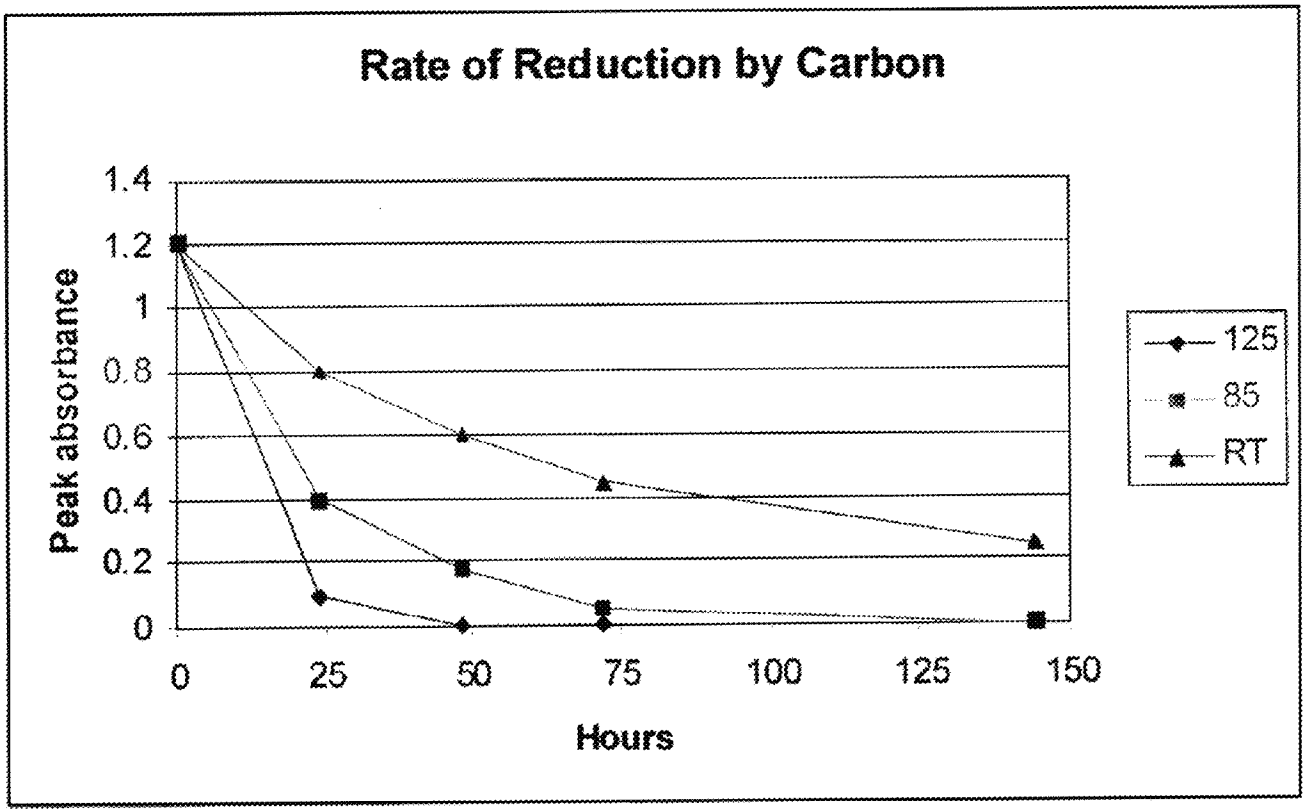
FIG. 3 depicts measured results for treatments using activated-carbon granules, the treated liquid having contaminants due to solder flux.

FIG. 3 depicts a graph of the peak absorbance of light at 200 nm as a function of time for exposure temperatures: 125° C., 85° C., and 20° C. (room temperature or RT). Absorbance peaks at or near 200 nm are indicative of the presence of organic compounds in the thermally-conductive liquid. As shown in FIG. 3, increased temperature resulted in increased rate of reduction in peak absorbance measured values. As discussed above, a reduction in peak absorbance is an indicative of a reduction in fluid contaminants.

B. Removal of Solder Flux Contaminant Using Different Scavenger Materials

In this example, three scavenger materials were compared for effectiveness: granular activated carbon, activated alumina, and molecular sieve material. The scavenger materials were used to treat a thermally-conductive liquid (Clearco 20 cSt PDMS liquid) having contaminants created by solder flux. The flux-contaminated PDMS was created using the procedure described above with respect to example A.

For the carbon treatment, 0.3 g of granular activated carbon was added to 10 ml of flux-contaminated PDMS. For the molecular sieve treatment, 0.5 g of 2-3 mm diameter molecular sieve material was added to 10 ml of flux-contaminated PDMS. For the alumina treatment, 0.3 g of granular activated alumina was added to 10 ml of flux-contaminated PDMS.

Each sample was placed in an oven at 125° C. Aging the samples at elevated temperatures over time simulates the long-term effects in an operating LED bulb. Each sample was tested for absorbance at 24, 48, and 72 hours.

Figure 4:
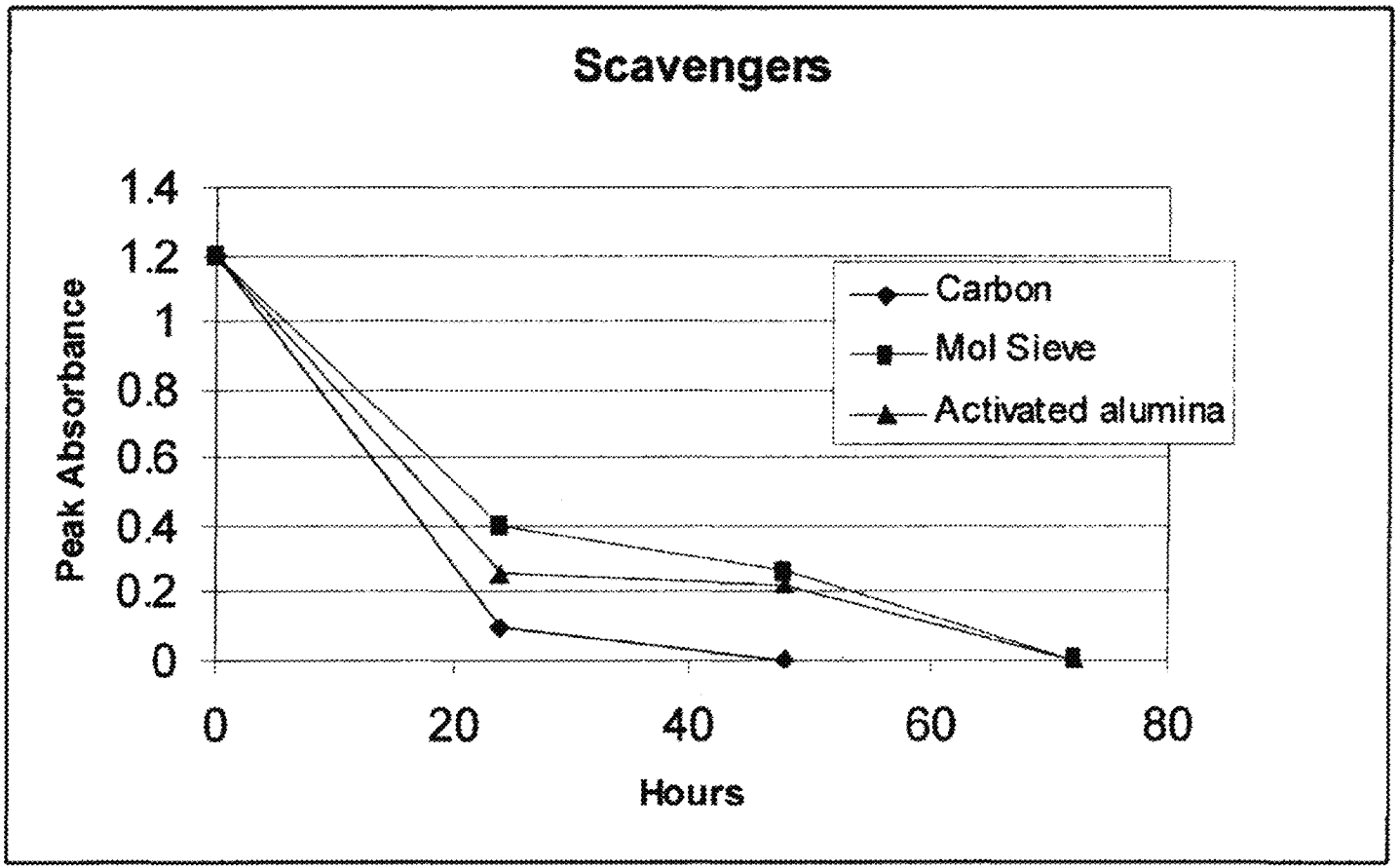
FIG. 4 depicts measured results for treatments using different scavenger materials, the treated liquid having contaminants due to solder flux.

FIG. 4 depicts the peak absorbance (over the UV-visible region of 200-700 nm) for each sample of the flux-contaminated PDMS treated with the scavenger materials, as described above. As shown in FIG. 4, all three scavenger materials were effective in reducing the optical absorption of the thermally-conductive liquid. The reduced absorption indicates a reduced concentration of contaminants in the flux-contaminated PDMS. The sample treated with activated carbon granules demonstrated some improved contaminant-reduction performance with respect to the other two scavenger materials, under these specific conditions.

C. Removal of Adhesive Contaminant Using Carbon Granules

In this example, a scavenger material comprising activated carbon granules was analyzed for effectiveness in reducing contaminants from another source. Specifically, the scavenger material was used to treat a thermally-conductive liquid having contaminants created by adhesive residue.

To create an adhesive-contaminated liquid, a cured "button" of Hysol E120-HP epoxy adhesive (approximately 0.3 g) was immersed in approximately 20 ml of Clearco 20 cSt PDMS liquid. The liquid containing the adhesive button was aged in an oven at 135° C. for 168 hours. Aging the sample at an elevated temperature accelerates the simulated exposure to the epoxy adhesive. The resulting composition is referred to in this example as Hysol-contaminated PDMS.

The presence of the adhesive button in the 20 ml of Clearco 20 cSt PDMS liquid resulted in a significant increase in peak absorbance relative to untreated PDMS liquid. Specifically, the peak absorbance of the Hysol-contaminated PDMS was measured at 1.45 for the UV-visible region of 200-700 nm.

To treat the Hysol-contaminated PDMS, washed, granular carbon was added to the Hysol-contaminated PDMS in a concentration of approximately 20 mg/ml. A first 10 ml vial of adhesive-contaminated liquid and carbon was aged in an oven at 125° C. A second 10 ml vial of adhesive-contaminated liquid and carbon was aged in an oven at 85° C. Both first and second vials were aged for 24 and 48 hours at oven temperature and then allowed to cool to room temperature. Aging the samples at elevated temperatures simulates the effects of the granular carbon in an operating LED bulb.

Figure 5:
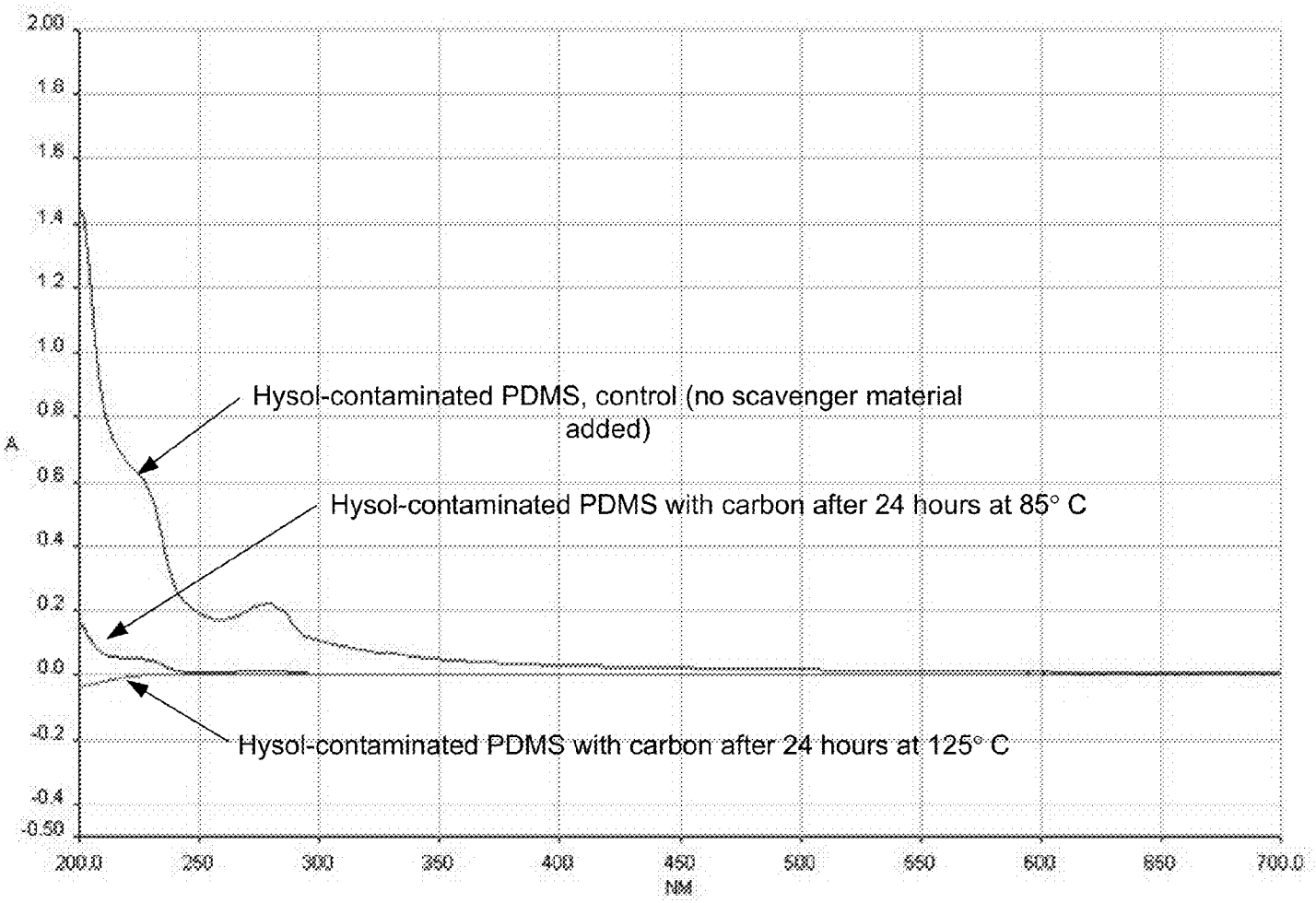
FIG. 5 depicts measured results for treatments using activated-carbon granules, the treated liquid having contaminants due to adhesive residue.

FIG. 5 depicts the absorbance spectra after 24 hours for the solution in the first (125° C.) and second (85° C.) vials as compared to a control having Hysol-contaminated PDMS without any carbon added. After 24 hours of aging, the 125° C. sample had a no absorbance peak, and after 48 hours of aging, the 85° C. sample had no absorbance peak. As shown in FIG. 5, the added granulated carbon was effective in reducing the absorption across a range of wavelengths including 200 to 450 nm. This indicates that the granulated carbon was effective at reducing Hysol-adhesive contaminant concentration levels.

D. Removal of Adhesive Contaminant Using Carbon Granules

In this example, a scavenger material comprised of carbon granules was analyzed for effectiveness for additional contaminants. The scavenger material was used to treat a thermally-conductive liquid having contaminants created by adhesive residue.

In this example, two adhesive-contaminated PDMS compositions were created using two different commercially available adhesives: U2360 urethane (Epoxies Etc.) and 4538 flexible epoxy (Cotronics). To create each adhesive-contaminated PDMS composition, approximately 0.35 g of adhesive was immersed in 18 ml of Clearco 20 cSt PDMS liquid. Each sample was aged at 135° C. for seven days. Aging the sample at an elevated temperature accelerates the simulated exposure to the adhesives. After aging, the adhesive solids were removed to create two adhesive-contaminated PDMS compositions: a urethane-contaminated PDMS and a 4538 epoxy-contaminated PDMS.

The DP-125 epoxy-contaminated PDMS and the 4538 epoxy-contaminated PDMS produced a visible haze in the PDMS liquid. The urethane-contaminated PDMS did not produce a visible haze.

Each adhesive-contaminated PDMS composition was treated by adding 0.1 g of washed carbon granules to 18 ml of contaminated PDMS. The carbon-treated samples were then placed in an oven and heated to 135° C. for 96 hours. Aging the samples at elevated temperatures simulates the effects of the carbon granules in an operating LED bulb.

Figure 6:
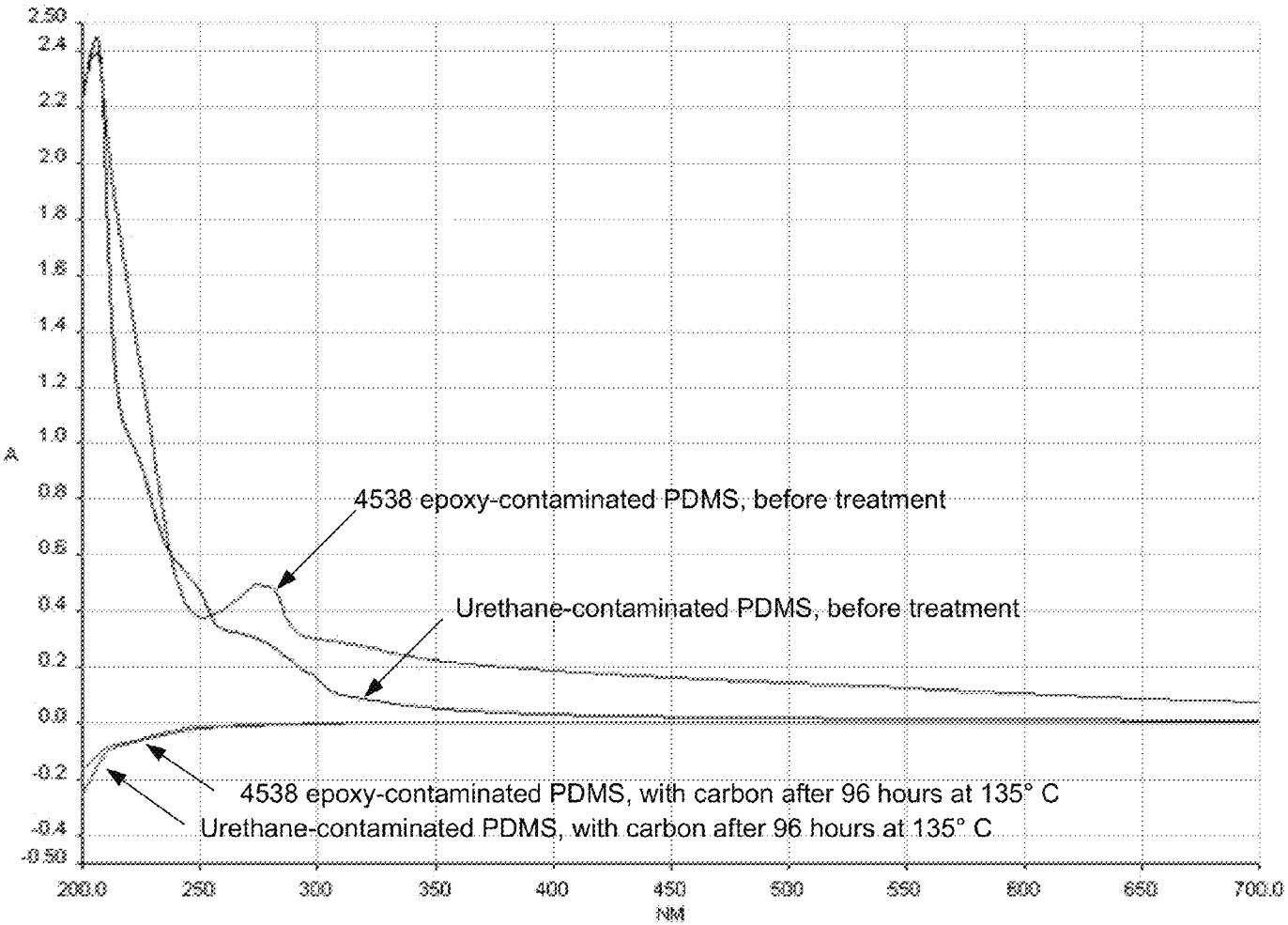
FIG. 6 depicts measured results for treatments using activated-carbon granules, the treated liquid having contaminants due to adhesive residue.

For all three carbon-treated samples, absorption was reduced to zero over the UV-Visible emission range. In addition, the visible haze in both the DP-125 epoxy-contaminated PDMS and the 4538 epoxy-contaminated PDMS was eliminated with the carbon treatment. FIG. 6 depicts the absorption spectrum for the urethane-contaminated PDMS and the 4538 epoxy-contaminated PDMS, before and after carbon treatment.

E. Removal of Unknown Contaminants Using Carbon Granules

In this example, a scavenger material comprised of carbon granules was analyzed for effectiveness for an unknown contaminant. The scavenger material was used to treat a thermally-conductive liquid having unknown contaminants.

In this example, the contaminated liquid was the result of long-term testing conducted using two prototype fixtures.

The first prototype fixture included Clearco 20 cSt PDMS liquid exposed to an ethylene propylene diene monomer (EPDM) rubber seal and a Viton rubber diaphragm. The liquid from this prototype is herein referred to as the first contaminated liquid. Before treatment, the first contaminated liquid was slightly yellow and tufts of suspended precipitate were visible.

The second prototype fixture Clearco 20 cSt PDMS liquid exposed to a Viton rubber seal and a Viton rubber diaphragm. The liquid from this prototype is herein referred to as the second contaminated liquid. Before treatment, the second contaminated liquid was slightly yellow and cloudy.

To treat the first and second contaminated liquids, 0.1 g of washed granulated carbon was added to vials having 15 to 18 ml of each liquid. The contents of each vial were aged in an oven for 96 hours at 135° C. Aging the samples at elevated temperatures simulates the effects of the granulated carbon in an operating LED bulb.

Figure 7:
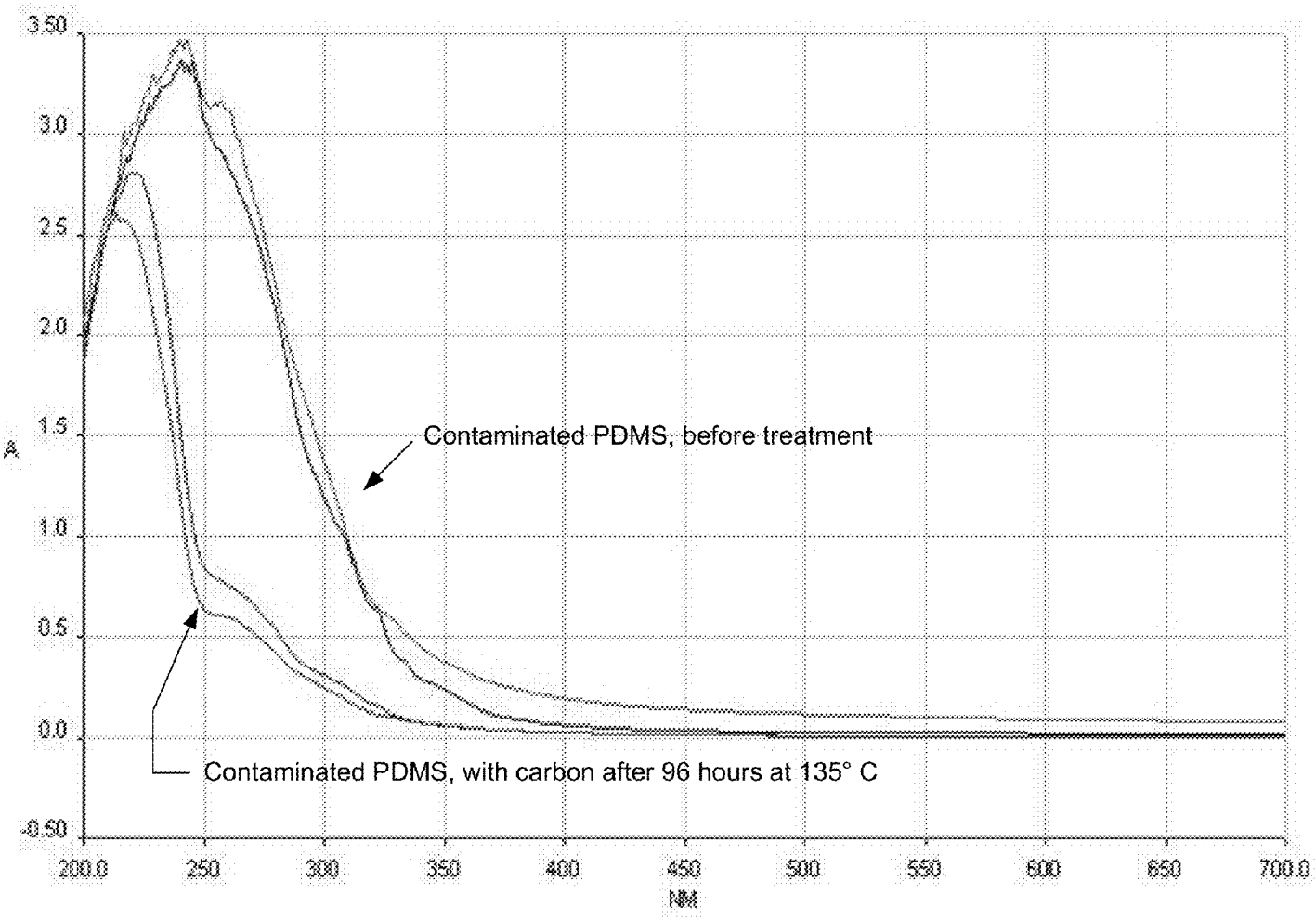
FIG. 7 depicts measured results for treatments using activated-carbon granules, the treated liquid having unknown contaminants.

FIG. 7 depicts the absorption spectrum of both the first and second contaminated liquid, before and after treatment. The visual haze and precipitate were eliminated by the carbon treatment, as confirmed by the near-zero absorbance of over 400 to 700 nm.

F. Removal of Solder Flux Contaminant Using Carbon Cloth

In this example, a scavenger material comprising carbon cloth was analyzed for effectiveness. The scavenger material was used to treat a thermally-conductive liquid having contaminants created by solder flux.

To create a flux-contaminated liquid, the same procedure was performed as in example A, above. That is, five 1 mm dots of Indalloy solder with NC-SMQ92J flux were placed on a clean copper strip and heated to 200° C. The copper strip was placed in the Clearco 20 cSt PDMS liquid and baked at 135°

C. for 120 hours. Aging the samples at an elevated temperature accelerates the simulated exposure to the flux material. The resulting solution is referred to as flux-contaminated PDMS.

The flux-contaminated PDMS was treated with both carbon cloth and washed granulated activated carbon. For the carbon cloth treatment, 0.07 g of carbon cloth was added to 18 ml of the flux-contaminated PDMS. The carbon cloth was made from a 0.5"×1.5" strip of Zorflex FM50K knitted carbon cloth from Chemviron Carbon. For the carbon-granule treatment, 0.07 g of washed granular activated carbon was added to 18 ml of the flux-contaminated PDMS. Both treatments were aged for 24 hours at 135° C. A control sample of flux-contaminated PDMS (without added carbon) was also aged for 24 hours at 135° C. Aging the samples at elevated temperatures over time simulates effects of the carbon in an operating LED bulb.

Figure 8:
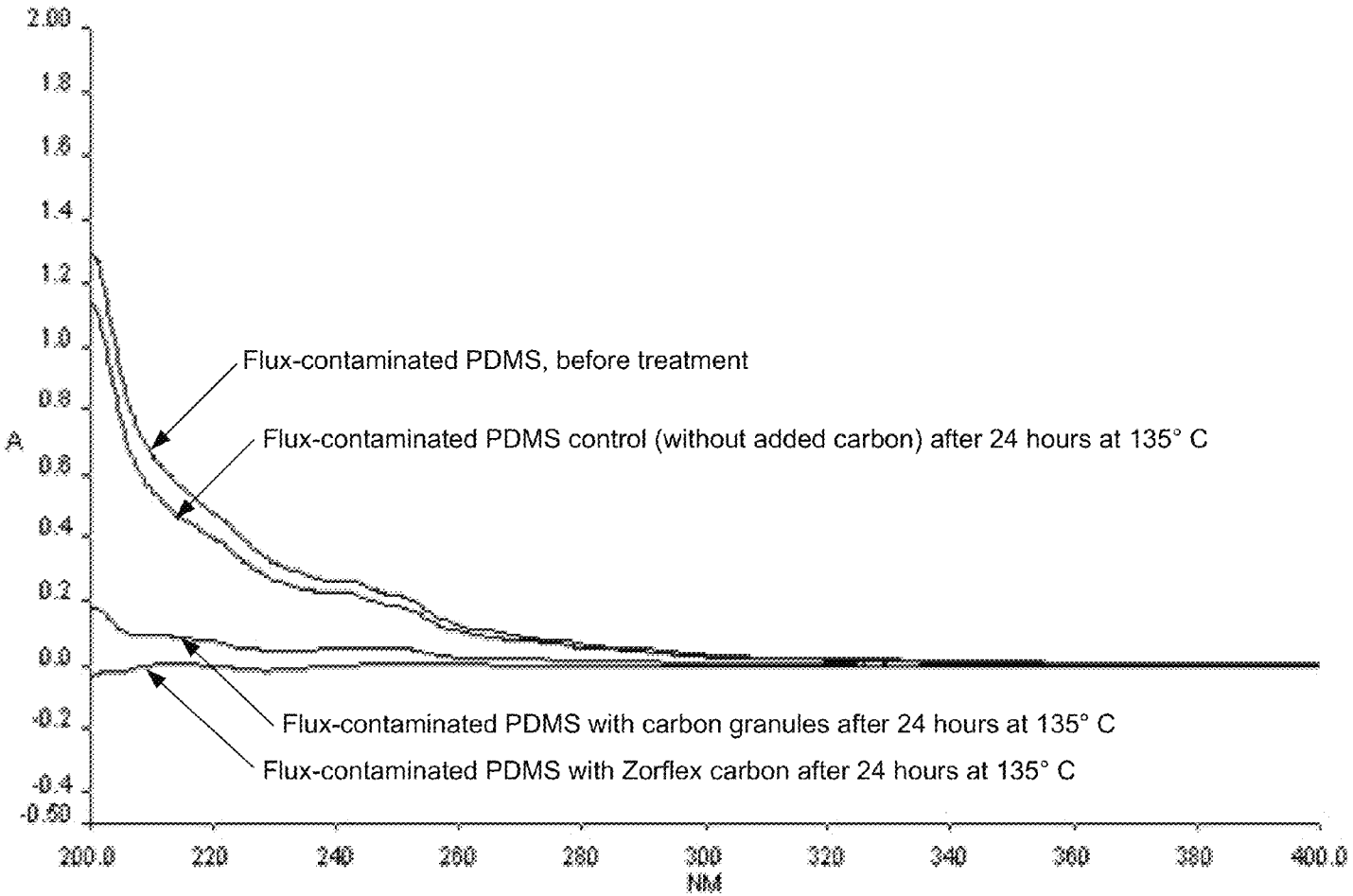
FIG. 8 depicts measured results for treatments using activated-carbon granules and activated-carbon cloth compared with a control sample, the liquid having contaminants due to solder flux.

As shown in FIG. 8, the carbon-granule treatment reduced the absorption across the UV-visible spectrum indicating a reduction in contaminant concentration. The carbon-cloth treatment resulted in no measurable absorption across the UV-visible spectrum indicating an effective elimination of contaminant concentration. The improved performance of the carbon-cloth treatment may be due, in part, to the higher surface area per unit weight of the carbon cloth as compared to carbon granules. Both samples treated with carbon resulted in significantly reduced absorption with respect to the control sample of flux-contaminated PDMS.

G. Removal of Precipitate Contaminant Using Carbon Cloth

In this example, a scavenger material comprised of carbon cloth was analyzed for effectiveness. The scavenger material was used to treat a thermally-conductive liquid having cloudy precipitate due to the presence of Viton rubber.

In a first composition, 0.4 g of purple Viton rubber was immersed in 18 ml of Clearco 20 cSt PDMS liquid. In a second composition, 0.4 g of purple Viton rubber and 0.0587 g of Zorflex FM50K carbon cloth were immersed in 18 ml of Clearco 20 cSt PDMS liquid. Both compositions were placed in an oven and baked at 135° C. for 72 hours. Aging the samples at elevated temperatures over time simulates the long-term effects in an operating LED bulb.

After aging, the first composition produced a cloudy precipitate upon cooling and had a small peak absorbance of 0.17 at 200 nm.

In contrast, the second composition using the carbon cloth did not produce precipitate on cooling. Additionally, there was no measurable absorbance for the second formulation after aging.

What is claimed is:

1. A method of making a liquid-cooled light emitting diode (LED) bulb configured to capture contaminants, the method comprising:

attaching a shell to a base to form an enclosed volume;

attaching a plurality of LEDs to the base, the plurality of LEDs disposed within the shell;

completely filling the enclosed volume with a thermally-conductive liquid; and attaching a scavenger element to the base, the scavenger element comprising a scavenger material that is configured to capture contaminants in the thermally-conductive liquid, wherein the scavenger element is attached in a location that exposes the scavenger material to the thermally-conductive liquid.

2. The method of making a liquid-cooled LED bulb of claim 1, wherein the scavenger element is attached in the location that allows the thermally-conductive liquid to circulate through the scavenger material via passive convective flow.

3. The method of making a liquid-cooled LED bulb of claim 1, wherein the LED bulb does not initially contain contaminants.

4. The method of making a liquid-cooled LED bulb of claim 1, wherein the scavenger material is an activated granular material, and wherein the scavenger element further comprises a liquid-permeable container that is attached to the base.

5. The method of making a liquid-cooled LED bulb of claim 1, wherein the scavenger material is an activated granular material, and wherein the scavenger material is disposed in a liquid-permeable chamber formed in the base.

6. The method of making a liquid-cooled LED bulb of claim 1, wherein the scavenger element comprises a ring of activated carbon cloth attached to the base, and wherein the ring of activated carbon cloth surrounds at least one LED of the plurality of LEDs.

* * * * *